US006250867B1

(12) United States Patent
Gwyn et al.

(10) Patent No.: US 6,250,867 B1
(45) Date of Patent: Jun. 26, 2001

(54) BINDER ASSEMBLY SYSTEM EMPLOYING AN INTEGRAL, BOOK-LIKE COVER AND ADHESIVE CHANNEL

(76) Inventors: Bruce A. Gwyn, 1104 Falcon St., Metairie, LA (US) 70005; Michael G. Johnson, P.O. Box 1058, Jonesboro, GA (US) 30237

( * ) Notice: Subject to any disclaimer, the term of this patent is extended or adjusted under 35 U.S.C. 154(b) by 0 days.

(21) Appl. No.: 09/119,488

(22) Filed: Jul. 20, 1998

(51) Int. Cl.[7] ..... B42C 11/02

(52) U.S. Cl. ..... 412/19; 281/15.1; 281/21.1; 412/4; 412/36; 412/902

(58) Field of Search ..... 281/15.1, 21.1, 281/36; 412/4, 8, 19, 36, 900, 902

(56) References Cited

U.S. PATENT DOCUMENTS

| | | | | |
|---|---|---|---|---|
| 3,749,423 | * | 7/1973 | Abildgaard et al. | 281/21.1 |
| 4,895,393 | * | 1/1990 | Shimizu | 281/15.1 |
| 5,066,182 | * | 11/1991 | Stonebraker et al. | 281/36 |
| 5,871,323 | * | 2/1999 | Clark | 412/4 |

* cited by examiner

*Primary Examiner*—A. L. Wellington
*Assistant Examiner*—Monica S. Carter

(74) *Attorney, Agent, or Firm*—Pugh/Associates, Patent & Trademark Attorneys; C. Emmett Pugh

(57) ABSTRACT

A binder assembly system, without a metal spine but only paper or paper-like material at its channel spine (15), for binding together a series of sheet materials (20), using an "hard cover" book-like, single-piece binding cover (10), made up of a number of main, structural parts, including two, side boards (11A & 11B), a sheet (12) of book covering material, and a centrally located, special paper spine element (13), with an internal, paper cover (14) which over-lies the combined width of the side boards and the paper spine element, all of which when combined together form the book-like binder cover using pre-heating and forming step (s). The various cover parts are pre-assembled together in their respective positions. The channel area of the cover is first pre-heated to facilitate forming in the range from about one hundred and fifty to four hundred (~150–400) degrees Fahrenheit and dwell times from about two to about thirty (~2–30) seconds. The channel area is forced into the desired, "U" shape under heat and pressure, using either a mating, male-and-female die or lateral directed forming bars or plates, using heat levels as before, pressure levels from about twenty-five to about two hundred and fifty (~25–250) pounds per square inch, and dwell times from about two to about fifteen (~2–15) seconds have been used successfully. The "U" shaped profile of the channel spine bends when subject to typical side loads but does not break or crimp but generally returns to its original configuration when the load is released.

4 Claims, 3 Drawing Sheets

BINDER ASSEMBLY SYSTEM EMPLOYING AN INTEGRAL, BOOK-LIKE COVER AND ADHESIVE CHANNEL

REFERENCE TO RELATED APPLICATIONS

This application relates to generally the same type of binder file end product as one of the co-inventor's co-pending applications, namely the applications of Bruce A. Gwyn, entitled "Cover-Less Binder Assembly System With Temporary, Easily Removable, Side, Guide Connections" filed Apr. 19, 1995, as Ser. No. 08/409,707, now abandoned, and "Binder Assembly System With Separate Guide Member" filed Jun. 2, 1995, as Ser. No. 08/459,411, issued as U.S. Pat. No. 5,733,087 on Mar. 31, 1998, the disclosures of which are hereby incorporated by reference; although it is noted that the type of binder file produced in the present invention is a "hard-bound" book-like cover with a centrally located, "U" shaped adhesive channel without any metal spine but instead only using paper or paper-like materials and with flanking, back and front covers, all integrated together as a unitary, binder file.

TECHNICAL FIELD

The present invention relates to a binder assembly system for binding together a series of sheet materials, such as, for example, paper for business reports and the like by an office worker, to produce a book-like item, with the binding typically being done along one edge using a cover spine with an integrated cover, that is, a spine with integrated front and/or back cover(s), preferably with both covers, wherein the sheet materials are brought together as a unit, placed into the "U" shaped central spine channel, and affixed to the spine channel, binding all of the components together in a "hard-bound" book-like structure. More particularly, the present invention relates to a combined "hard" cover and channel spine of the type of which the inside or interior of the channel spine is provided with an amount of glue meltable under the influence of heat. When the glue solidifies, the sheets are joined together and retained in the spine channel. Even more particularly, the present invention relates to the method of making an integrated "hard" binding cover using pre-heating, forming and channel-adhesive-applying steps, and the end product, which includes a "hard" cover for binding together sheets of material in a final, end-user-applied, heating step, ultimately producing a "hard-bound" book-like structure. In the formed, integrated binding cover, which includes a formed channel, a final adhesive-applying step produces, for example, a series of preferably cold-melt, heat-flowable glue spots or areas applied along the channel's length preferably at spaced intervals.

BACKGROUND ART

Some prior patents or publications which may be of interest are listed below:

| Patent No. | Inventor(s) | Issue Date |
|---|---|---|
| 2,782,056 | Allegretti | 02/19/57 |
| 1,029,687 (GB) | Print & Plastics | 05/18/66 |
| 3,292,951 | Schoenberger | 12/20/66 |
| 1,289,821 (GR) | Neuse | 02/27/69 |
| 2,091,234 (FR) | IPC Services | 01/14/72 |

-continued

| Patent No. | Inventor(s) | Issue Date |
|---|---|---|
| 3,739,412 | Card et al | 06/19/73 |
| 3,840,254 | Shatzkin | 10/08/74 |
| 3,957,287 | Hall et al | 05/18/76 |
| 4,009,498 | Staats | 03/01/77 |
| 2,145,033 A (GB) | Smith | 03/85 |
| 4,531,874 | Voges | 07/30/85 |
| 240-176-A (DD) | Inst Grafische Tech | 10/22/86 |
| 2,197,156 (UK) | Peleman | 05/88 |
| 4,828,645 | Van Bortel | 05/09/89 |
| 4,958,974 | Schenk | 09/25/90 |
| 412,742 A2 (EPC) | Schenk | 02/13/91 |
| 5,078,563 | Lolli | 01/07/92 |
| 5,246,325 | Morishige et al | 09/21/93 |
| 5,340,155 | Podosek | 08/23/94 |
| 9,201,094 (BG) | Peleman | 12/14/92 (filed) |
| 9,300,981 (BG) | Peleman | 09/21/93 (filed) |
| 5,425,554 | Lamanna | 06/25/95 |
| 5,733,087 | Gwyn | 03/31/98 |

It is a common desire in, for example, office settings, to bind sheet materials together, such as, for example, a selected collection of papers, along one edge for finished reports, product information, data collection, etc., and the like. To achieve this, a binding industry has been created to produce various approaches to binding the selected materials together using, for example, spiral binding, adhesive binders, pin binders, etc.

In a simple method of adhesive binding, the binding assembly includes a binding element, typically a file consisting of a front cover, a back cover and a spine channel on the inside of which is provided an amount of glue which melts upon the influence of heat. The sheet materials (or sheets) are joined together as a unit and placed inside the binding element in contact with the glue. Upon application of heat, the glue melts and the edges of the sheets intrude into the glue layer. After the heat is removed from the binding element, the glue solidifies which results in the sheets being bonded to each other and retained in the binding cover or element by means of the glue. See, for example, U.S. Pat. No. 5,078,563 (Lolli), U.S. Pat. No. 5,425,554 (Lamanna), and G.B. 2,145,033 (Smith).

Typically, the spine channel has a "U" shape cross-section. A heat-flowable, relatively thick, adhesive strip layer is located inside the "U" shape and along its bottom. Additionally, in the prior art, back and front covers (transparent or opaque) may be attached along each of the spine side walls or edges.

It is also known in the prior art to apply an element of a heat conducting material, such as metal, on the spine. The heat conducting element allows an efficient transfer of heat to the glue, such that the glue melts uniformly across the inside of the spine. The heat conducting element may have a "U-shaped" profile which also functions to reinforce and support the connection between the glue and the edges of the sheets. When the bundle of sheets are laid down and opened, or when the pages are turned, the parallel walls of the U-shaped element supports the weight of the paper and guards the glued connections. See, for example, Lamanna '554, and G.B. 2,197,156 (referenced in Lamanna '554).

Typically, the U-shaped heat-conducting element is located at the inside of the file. In such an arrangement, it is difficult to place uniformly all the sheets into the U-shaped profile, especially when dealing with thick bundles. The most recent, asserted improvement to the prior art, as disclosed in U.S. Pat. No. 5,425,554, issued to Lamanna, attempts to address that problem by positioning the actual file on the inside of the heat conducting element. A further disclosure has the file covers only partially adjacent the "U-shaped" heat conducting element; the typical spine is replaced with the heat-conducting element, then acting as the spine of the binding element. The glue is applied directly to the inside of the spine/heat-conducting element.

In this prior art, the spine is specifically manufactured from a hard, heat-conducting material with little or no bendability, typically, a metal, such as steel. For primarily aesthetic purposes, a covering is applied on the exposed exterior of the spine or completely around the spine. The cover is usually an "elegant," decorative material such as printed paper.

The above-mentioned metal spine design may be incorporated with another recent improvement in binding assemblies, the cover-less spine. In this disclosure, the front and back covers of the file are excluded. In previous disclosures by the present inventor (see the Gwyn applications referred to above), the cover-less spine is equipped with temporary, easily removable, guide members for guiding the sheets into the spine.

The above-mentioned metal spine design has also been incorporated into "hard-bound" book-like covers.

Although recent improvements in the prior art have resulted in a simpler, less expensive method of binding sheet materials, there is still room for further improvements. Problems persist in the prior art which have not been successfully addressed. Meanwhile, new challenges have surfaced from recent improvements.

The primary problem with the use of a metal element for the spine or heat-conducting element, arises when the spine is subject to certain bending loads and other external loads and strain present during shipping, handling and use. The stiff, inflexible metal element, and thus the spine, has a tendency to become and stay crimped, thereby mis-aligning the sheet materials, and further inducing excessive wear. It also difficult for a book or bound collection of sheet materials to remain open at certain pages when laid down. This is not only unattractive and burdensome, but it also creates an unprofessional appearance to the bound report, product catalog, etc.

Another undesirable aspect of the metal spine is that it generally appears dull and uninviting. As an attempted remedy, a decorative covering around the binding element is usually added to hide the metal surface; see, e.g., the Lamanna ('554) patent. Although the present invention uses an aesthetically pleasing cover, this prior art approach, however, significantly compromises the simplicity in the manufacture and application of the binding assembly and adds far more complexity to the manufacturing process.

Another problem persistent in known adhesive binding assemblies is related to the use of overly large quantities of hot-melt glue for the heating and binding operation, with such large quantities being added apparently to ensure adhesion, with the glue typically being overly added in a long, continuous strip of a relatively great thickness. However, not to mention the cost of such an excessive amount of glue or adhesive, during the heating step, the adhesive glue has the tendency to flow up and around, not only the edges of the sheet materials to be bound, but beyond the binding areas and onto exposed areas of the sheet materials, covers or upper edges of the channel spine. In the invention a more appropriate amount of glue is added in a straight, continuous ribbon or, alternatively, in the form of spaced dots of glue, although this aspect is not central to the present invention's patentable contribution to the useful arts.

In the present invention preferably both covers are included, both of which typically are opaque, and which, unlike most of the prior art, provides a relatively "hard," thicker cover, producing a "hard-bound" book-like cover product without using any internal metal spine, which then can be used in a final, user-applied heating step to produce a final, "hard-bound" book-like product.

The "hard-bound" book-like product of the invention has been long sought after in the prior art but until the present invention has not been possible in an economical, "hard" but somewhat flexible product that avoids the problems of the hard covers of the prior art, particularly those that include an internal metal spine forming the cover's central channel.

The present invention thus is designed to provide an alternative solution which avoids, or at least diminishes, the prior art problems, while providing new, valuable and innovative improvements over the prior art.

GENERAL SUMMARY DISCUSSION OF INVENTION

The present invention is directed to a "hard-back," book-like binder assembly system for binding together a selected collection or sheaf of sheet materials, e.g., paper, including front and back covers, wherein the centrally located, elongated, binding spine is provided in the form of a central, formed, adhesive carrying channel, preferably made of paper and like materials, without any internal, metal spine, integrally formed and integrally connected with side, integral, flanking, front and back covers.

A primary goal of the present invention preferably is to create a flexible channel in a flat cover, that is, a cover that lies flat when put exterior-down on a supporting surface without the use of any internal or external, metal spine member. The cover of the invention includes a centrally located, longitudinally extended channel into which the pages to be bound are placed, flanked by two, side covers, a back cover and a front cover, with the three elements being integrated together into a single, "hard-bound" book-like item or piece. The joining areas between the side covers and the channel spine are very flexible, allowing the side covers to lie essentially flat or lie down on a supporting surface.

The end results of such a desired, binding cover can be achieved through several manufacturing techniques, but the basic process steps of the exemplary, preferred embodiments of the methods of the present invention include the following steps or procedures.

Pre-Assembly

The various parts that go to make up the hard-bound, book-like cover are pre-assembled together in their respective, relative, final positions.

Pre-heat

The channel area of the cover is first pre-heated to facilitate forming. The pre-heat temperature and pre-heat time are determined by the materials being formed. Pre-heat temperatures ranging from about one hundred and fifty (~150° F.) degrees Fahrenheit to four hundred (~400° F.) degrees Fahrenheit and dwell times from about two (~2 secs.) to about thirty (~30 secs.) seconds have been used successfully.

However other temperatures and dwell time levels may be used depending on the requirements of the selected materials. With some materials the pre-heat phase can be combined with the forming phase in a single combined step.

Form

The channel area can be formed using, for example, one of two alternative procedures.

The first procedure uses a mating male-and-female die. The channel area is forced into the desired, "U" shape between the matched dies under heat and pressure. Heat levels from about one hundred and fifty (~150° F.) degrees Fahrenheit to four hundred (~400° F.) degrees Fahrenheit, pressure levels from about twenty-five to about two hundred and fifty (~25–250 psi) pounds per square inch, and dwell times from about two (~2 secs.) to about fifteen (~15 secs.) seconds have been used successfully.

However other temperatures, pressure and dwell time levels may be used depending on the requirements of the selected materials.

The second procedure uses lateral pressure, form forming bars or plates to create the channel. The form applies downward pressure on the channel area, then the lateral forming bars move in to hold the cover in the proper position under the desired heat, pressure and dwell time. Heat, pressure, and dwell time are similar to those of the first, "male/female-die" method.

At some point in the process, it can be advantageous to apply a stiffening agent or element to the area where the channel will be created. This helps hold and maintain the spine in the desired channel form. Protein and epoxy stiffeners have been successfully used in product trials. However, other compound may be preferable, depending on the physical characteristics of the selected cover material. In product trials, it was discovered that not all cover materials require a stiffener.

Glue Application

Heat activated adhesive is applied in the interior base of the channel, which typically is "U" shaped. The adhesive will be reactive at a later time to complete binding, typically by the end-user, for example, an office worker. The adhesive can be applied in a ribbon, a bead, as dots, or any other acceptable pattern and thickness appropriate for the end use. The details of this step are not directly part of the innovations of the present invention and are well known in the art.

The foregoing are the basic steps of the exemplary embodiments of the methods of the present invention and can be accomplished through a variety of manufacturing techniques, ranging from manually operated equipment to fully automated equipment. The automation level will be dictated by the desired production rate.

When the end-user of the "hard-bound" type binding cover of the invention, applies heat, using, for example, a binding heater as disclosed in the cited Gwyn applications referenced at the beginning hereof, the glue melts, causing it to flow in and around the edges of the sheet materials positioned at the base. When the heat is removed, the glue cools and solidifies, thereby binding all the individual sheets material together and retaining them within the spine channel between the front and back covers of the binding cover.

Although the binding cover of the invention appears like the "hard" cover of a "hard-bound" book, the channel itself retains a degree of flexibility or lack of absolute rigidity, allowing, for example, some cross or twisting forces or pressures to be applied to it without permanently deforming it, in contrast to those prior art "hard" (as well as non-hard) covers or cover-less binding spines that use a metal spine.

One of the benefits of having a binder cover made of all paper or paper-like material, as in the invention, including both the spine and the front and back cover panels, is that the cover can be recycled for further use.

Additionally, the binder cover has less weight than one with a metal spine insert, as in the prior art, which can be particularly important in shipping costs and shipping damage.

Likewise, the binder cover of the invention safely can be used in connection with, for example, "instant" baby and children books done on special order machines that customize books in accordance with a customer's order, whereas, those with metal inserts can present sharp cutting edges which can be dangerous for baby and children oriented books and the like.

It is also noted, that, although the details of the thermal glue addition to the bottom interior of the book cover's spine area are not per se part of the present invention, the presence of such thermal glue is necessary for the manufactured end-product to be a binding cover for further binding use by the end-user.

It is thus an object of the invention to provide a "hard-bound" book-like binding system which remains structurally intact during shipping, handling and use, more specifically, a system which avoids permanent crimping at the channel spine area.

It is a further object of the invention to provide a "hard-bound" book-like binding system with a cover having a flexible channel spine capable of some significant bending under the influence of external loads, and returning to its original shape and configuration when the load is released.

It is a further object of the invention to provide a "hard-bound" book-like binding cover which is aesthetically pleasing and which offers the user a variety of colors or design to choose from without compromising structural and functional integrity or significantly adding to the cost of manufacture.

It is a further object of the invention to provide a "hard-bound" book-like having a channel spine which reduces glue usage and glue seepage.

It is a further object of the invention to provide such a system which is relatively inexpensive and reliable in operation and easy to use.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein:

FIG. 3 is an end view of the completely assembled parts of FIGS. 1 & 2 for the "hard-bound" book-like cover, as the forming step is taking place using a downwardly moving male member (note direction arrows) to form the "U" shaped, central channel spine working against a female, "U" shaped member (not shown for simplicity purposes); while

FIG. 7 is a flow-chart diagram showing the method steps of an exemplary embodiment of the method of the present invention used to form the completed "hard-bound" book-like, binder cover of FIGS. 4 & 5.

EXEMPLARY MODES FOR CARRYING OUT THE INVENTION

Figure 1:
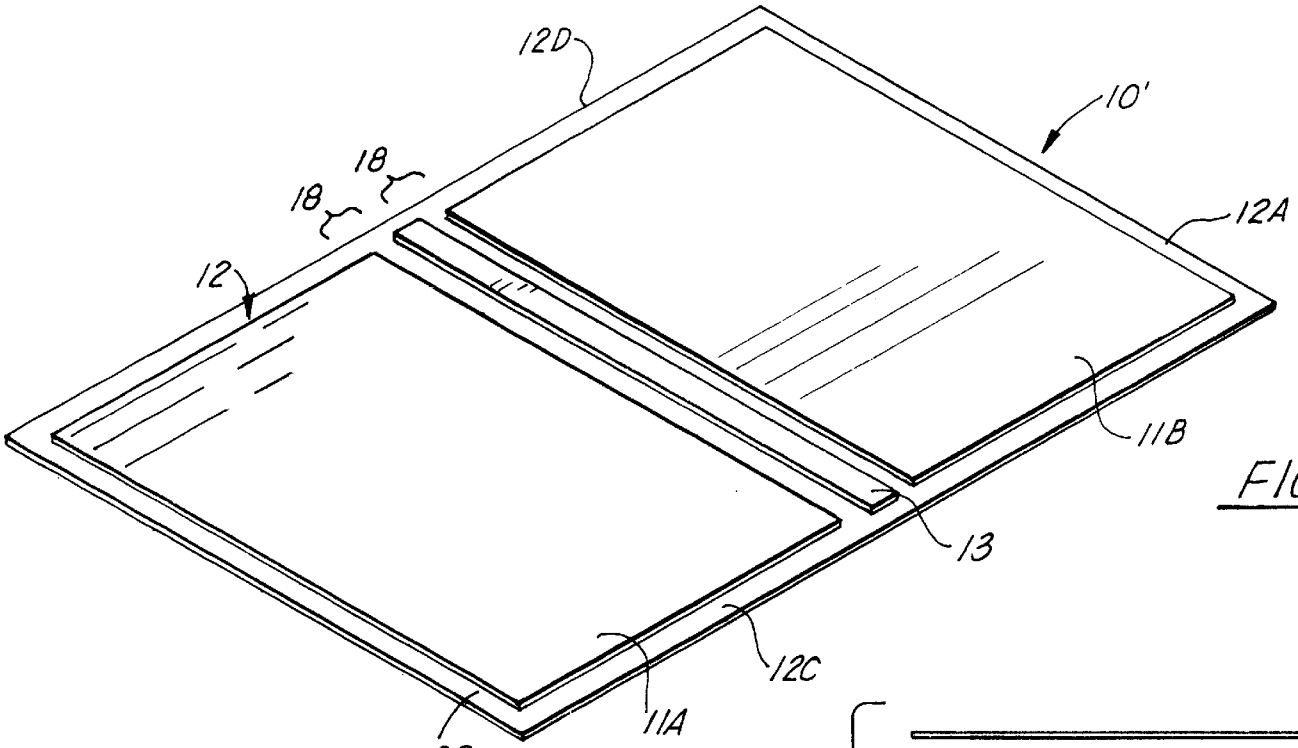
FIG. 1 is a plan view of the preferred, exemplary embodiment of the assembled, main, structural parts, including the side boards and the central special paper spine element, used to make up the "hard-bound" book-like, binding cover of the present invention, showing the main parts of the cover before the final covering paper is applied over the main parts in the pre-heating, forming steps yet to be performed.
Figure 2:
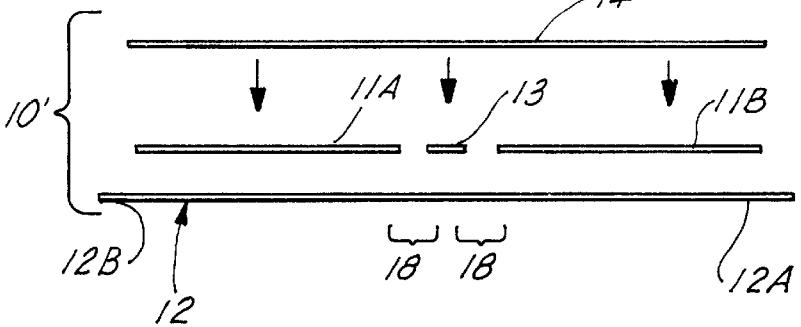
FIG. 2 is an end, top view of the assembled, main, structural parts of FIG. 1 for the "hard-bound" book-like cover, but in exploded array and with the covering paper positioned above the main parts prior to the final assembly and forming steps.

As can be seen in FIGS. 1 & 2, the exemplary embodiment of the "hard-bound" book-like, binder cover 10' (in its final form numbered 10) of the invention includes a number of main, structural parts, including two, side boards 11A & 11B, an exterior sheet 12 of book covering material and, optionally, a centrally located, special paper spine element 13, used to make up the final "hard-bound" book-like, binding cover 10. As can be seen in FIG. 1, the sides of the paper spine element 13 are positioned adjacent to but spaced from the sides of the boards 11A & 11B, the three parts being positioned in a parallel array symmetrical about the center-line axis of the paper spine element. A final part is the typically decorative, internal, paper cover 14, which can have a plain exposed side and which over-lies and covers over the combined width of the side boards 11A & 11B and the paper spine element 13, all of which when combined together form the final binder cover 10 in pre-heating and forming step(s) to be described more fully below, with the forming step producing the "U" shaped channel 15.

The book covering material 12 can be, for example, twelve (12") inches high by nineteen inches wide (12"×19") and be made of "Rainbow 7" paper material from Ecological Fibers, Inc. of Lundenberg, Mass., which is a "Latex" coated paper and is seven point paper in size, and provides a finished look for the exterior of the cover 10; while the two side boards 11A & 11B each can be, for example, eleven and a quarter inches high by eight and a quarter inches wide (11¼"×8¼") and be made of, for example, B-grade chip board made of recycled paper fiber material, universally available, about a sixteenth of an inch (1/16") thick; while the centrally located, paper spine element 13 can be, for example, eleven and a quarter inches high by three-quarters of an inch wide (11¼"×¾") and be made of, for example, 018 Kraft paper. When the spine stiffening element is used, there typically would be a gap of approximately a quarter of an inch (¼") between one of its side edges and the adjacent side edge of the side board, an area which forms one of the two "hinges" 18 adjacent to and right above the upper edges of the channel 15. The interior, covering paper 14 can be, for example, ten and three-quarters inches high and seventeen and a quarter inches wide (10¾"×17¼") and be made of, for example, 70# bond paper, which also is well known and universally available. These are, of course, merely exemplary and subject to great variation in material and dimension.

Figure 5:
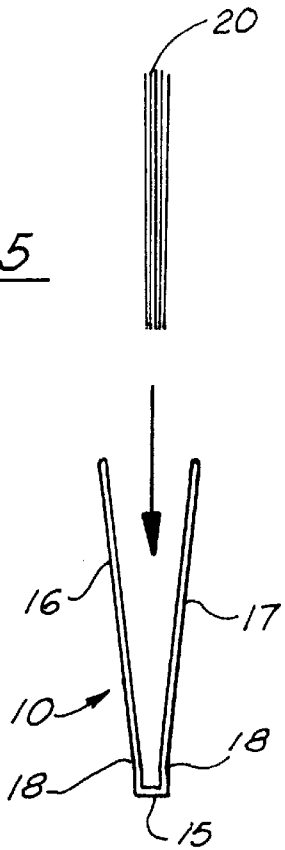
FIG. 5 is an end view of the finished, "hard-bound" book-like, binder cover, being used by the end-user to bind the exemplary sheet materials which are being inserted down (note direction arrow) into the interior of the exemplary embodiment of the finished, binder cover of the invention, which, after complete insertion and assembly of the sheet material into the cover, typically will then be inserted into the slot of a heating unit for heating the adhesive in the interior of the binding spine channel, causing it to flow and bind all of the individual sheets of material to the cover when it cools.

When finished and formed in accordance with one of the exemplary methods of the present invention, the finished binding cover preferably presents an attractive, functional, hard-bound-like cover for the ultimately bound, interior sheet materials 20 (see FIG. 5), preferably having all the appearance of a quality, hard-bound book.

Figure 6:
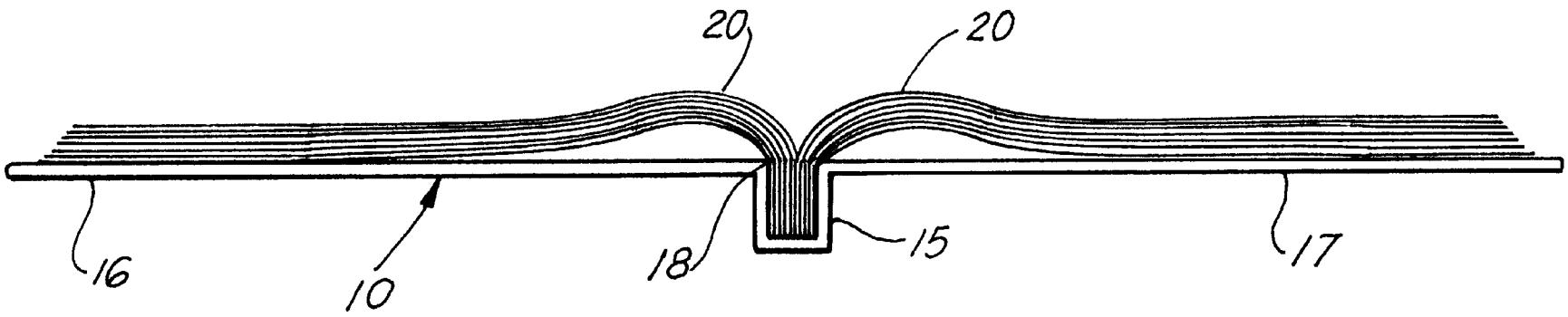
FIG. 6 is an end view, similar to FIG. 5, showing the completed, bound, book-like structure in its final form, showing its capabilities of lying flat on a supporting surface (not illustrated).

As noted above, a primary goal of the present invention is to create a flexible channel (15) in a flat, binding cover (10), that is, a binding cover that lies flat when put exterior-down on a supporting surface (see FIG. 6). Such a cover (10) includes a centrally located, longitudinally extended channel 15 into which the pages 20 to be bound are placed, flanked by two, integral, side covers, a front cover 16 and a back cover 17, with the three elements being integrated together into a single item or piece to form a hard-bound, book-like structure.

These desired, end results can be achieved through several manufacturing techniques, but the basic process steps of the exemplary embodiments of the methods of the present invention include the following.

Pre-Assembly

The main parts 11–13 are assembled in the manner illustrated in FIG. 1. They can be merely set into their relative positions illustrated or initially adhered together so that they better hold their respective positions. These parts are then adhered together on the exterior cover sheet 12 with the peripheral edges 12A–12D of the exterior cover material 12 folded over the peripheral edges of the interior elements, namely, the relatively stiff, side boards or panels 11*a* & 11B and the top ad bottom edges of the paper spine 13, to produce a turned-edge cover 10', using, for example, available turned-edge book cover assembly machinery, well known in the book cover art. The interior cover 14 is then put down (note directional arrows) into position as generally illustrated in FIG. 2, and adhered into position covering over the turned-over edges of the exterior cover sheet 12 and providing a finished surface on the interior of the cover 10'. As should be understood, the relatively stiff, side panels 11A & 11B, along with the paper spine 13, are sandwiched between the exterior, flexible cover sheet 12 and the interior, flexible cover sheet 14, with the gaps 18 between the paper spine and the side panels forming hinges for the front and back cover panels.

Pre-heat

The channel area (15) of the cover 10 is first pre-heated to facilitate forming. The pre-heat temperature and pre-heat time are determined by the materials being formed.

Pre-heat temperatures ranging from about one hundred and fifty (~150° F.) degrees Fahrenheit to four hundred (~400° F.) degrees Fahrenheit and dwell times from about two (~2 secs.) to about thirty (~30 secs.) seconds have been used successfully.

However, other temperatures and dwell time levels may be used depending on the requirements of the selected materials. With some materials the pre-heat phase can be combined with the forming phase in a single combined step.

For the exemplary, detailed materials provided above, the materials of FIGS. 1 & 2 are pre-heated to about two hundred and fifty (250° F.) degrees Fahrenheit for about fifteen (15 secs.) seconds.

Form

The channel area (15) can be formed by the use of, for example, two, alternative, forming methods.

Figure 3:
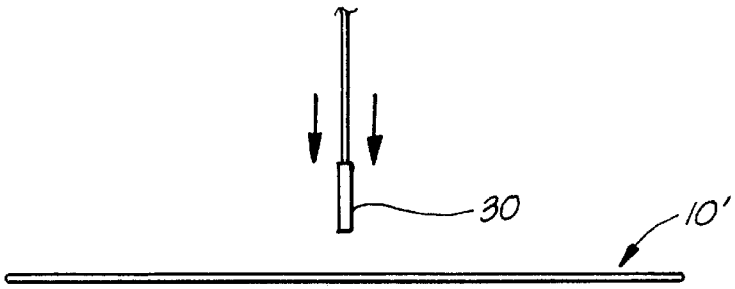
Figure 4:
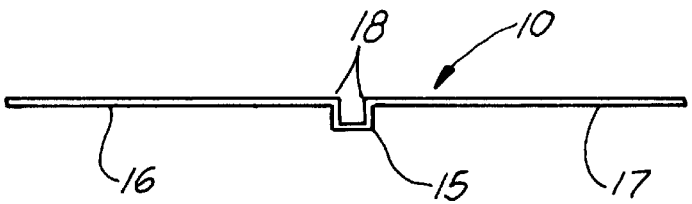
FIG. 4 is an end view of the completely assembled parts of FIGS. 1 & 2 for the "hard-bound" book-like cover, similar to FIG. 3, but after the forming step has taking place, thereby forming the "U" shaped, central channel spine shown in this figure, after which the hot melt adhesive is dropped into the channel, producing the exemplary embodiment of the "hard-bound" book-like, binder cover of the invention, ready to be shipped, for example, to the end-user for the end-user's use in binding sheet materials into the cover.

The first, alternative procedure uses a mating mal- and-female die, as generally illustrated in FIG. 3, with only the male, extended bar die part 30 being shown for simplicity, but with the mating female part being shaped like a squared-off, "U" shaped trough. The channel area is forced into the desired shape 15 (note FIG. 4) between the matched dies under heat and pressure. Heat levels from about one hundred and fifty (~150° F.) degrees Fahrenheit to about four hundred (~400° F.) degrees Fahrenheit, pressure levels from about twenty-five to about two hundred and fifty (~25–250 psi) pounds per square inch, and dwell times from about two (~2 secs.) to about fifteen (~15 secs.) seconds have been used successfully.

However other temperatures, pressure and dwell time levels may be used depending on the requirements of the selected materials.

For the exemplary, detailed materials provided above and the exemplary, detailed pre-heat temperature and time period provided above, the assembled materials of FIG. 2 are heated to about two hundred and fifty (250° F.) degrees Fahrenheit with pressure of about fifty (50 psi) pounds per square inch with a dwell time of about eight (8 secs.) seconds using the male/female (latter not illustrated) die (note FIG. 3).

A second, exemplary, alternative method uses lateral pressure applied from forming bars or plates (not illustrated) to create the channel 15. The form applies downward pressure on the channel area (15), then lateral forming bars move in to hold the cover (10) in the proper position under the desired heat, pressure and dwell time. Heat, pressure, and dwell time are similar to those of the first, "male/female-die" method.

In the exemplary structure and method discussed in detail above, it was considered advantageous to apply at some point in the process a stiffening agent particularly to the area where the channel (15) is to be created. This helps hold the channel spine 15 in the desired "U" shaped, channel form.

Protein and epoxy stiffeners, such as, for example, "Wisdom" brand adhesives from H.E. Wisdom & Sons, Inc., Franklin Park, Ill., have been used successfully in product trials. These can either be sprayed on, particularly in the channel spine area (15), or mixed in with the general glue (e.g. "Wisdom" #510) used to adhere the basic parts 11–14 of the cover (10) together, and a mixture of "Wisdom" #510 glue (which is a normal, protein animal glue commonly used in the book making art) and #6573 adhesive (also being a protein animal product but serving as an additive for causing the glue to harden quicker and having a greater gram strength, which #6573 additive in the invention serves the further function of being the stiffening agent needed in the central channel spine area 15) mixed therein have shown to provide the desired degree of stiffening agent, which provides the stiffening agent throughout the cover (10). However, other compounds may be preferable, depending on the physical characteristics of the selected cover materials. In product trials, it was also discovered that not all cover materials require the addition of a stiffening paper spine (13) and with the properly selected materials for the interior and exterior cover sheets 12 & 14, a cover (10) could be made without the special paper spine 13.

Glue Application

Heat activated adhesive (not illustrated for simplicity purposes), to be used for the end-user-applied, heat-binding step, is applied in the interior of the channel 15. The adhesive will be reactive at a later time to complete the binding of paper or other sheet materials to the binding cover 10. The adhesive can be applied in a ribbon, a bead, as dots, or any other acceptable pattern and thickness appropriate for the end use. The details of this step are not directly part of the present invention and are well known in the art.

It is noted that the initial product trials the heat-binding glue was put on in the channel 15 in a continuous ribbon fashion. However, a significant reduction can be achieved in the amount of glue required for the final, end-user, heating and binding step, partially due to a different method of glue application. Rather than applying a thick adhesive layer onto the inside of the channel spine 15, a reduced amount preferably is introduced via the spot method. The cool-melt glue preferably is spot-applied along the length of the channel spine 15, with the series of spots spaced at, for example, regular intervals. In combination with the improved channel spine design, this reduced amount of glue is sufficient to bind the sheets together.

A related benefit is that there is at least less, if not no, seepage into the exposed areas of the sheets, the sides of the covers 16 & 17 closest to the channel 15, or the channel spine 15 itself. Overall, the binding operation is not only more efficient, it is also cleaner.

In the preferred, exemplary embodiment, the binding glue employed for the channel 15 for the end-user binding can be, for example, "Dexter Hysol," a cool melt glue which is heat-flowable at a temperature below, for example, two hundred and eighty (280°) degrees Fahrenheit.

The completed, hard-cover binding cover 10 (FIG. 4, plus the applied channel glue) is provided as a completed item of manufacture to, for example, the end-user.

The foregoing are the basic steps of the exemplary embodiments of the methods of the present invention and are summarized in the flow-chart of FIG. 7, and can be accomplished through a variety of manufacturing techniques, ranging from manually operated equipment to fully automated equipment. The automation level will be dictated by the desired production rate.

The end-user then ultimately inserts the sheet materials 20 (note FIG. 5), desired to be bound into a book-like structure, into the finished cover 10. The combined sheet material 20 and cover 10 are inserted, channel spine (15) end first into, for example, an appropriate thermal heating unit, such as, for example, the UNIBIND® model "S12," or other appropriate heating unit, to heat the binding adhesive or series of glue spots and cause the layer of adhesive to pool or puddle around the side edges of the inserted paper to be bound.

After this end-user-applied, heating step, the flowing cool-melt glue solidifies within only about ten (10 secs.) seconds, after heat is removed, i.e., the binder cover and pages being bound are removed from the heating unit. The result is a "hard-bound" book-like structure.

When the completed "hard-bound" book 10+20 is placed on a supporting surface, it tends to lie flat, as generally illustrated in FIG. 6.

It is further generally noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A binding assembly cover for binding together a selected collection of sheet materials in a final, heating, binding method step performed by an end-user, comprising:

a hard, book-like cover having a hard front cover, and a hard back cover, said hard front and back covers integrally joined together at hinge lines by a centrally located, initially flat spine, with which the hard front cover and hard back cover all initially substantially lie flat in a common plane when integrally joined together, which initially flat spine is ultimately formed into a "U" shaped channel spin having a base and an interior and a bottom at said base of the "U" shape, heat binding heat-flowable glue being located along said bottom, said heat-flowable glue substantially pooling when heated to flow up and around the edges of the sheet materials when located in said interior of said spine during the heating, binding steps binding the sheet materials into said channel spine, and said channel spine being made up of material selected from the group consisting of flat, paper and paper like materials, devoid of any metal spine, said channel spine being capable of significant bending flexibility without crimping, then returning to its original configuration.

2. The binding assembly cover of claim 1, wherein:

said front and said back covers each include a sheet of relatively stiff material sandwiched between an interior, flexible cover sheet and an exterior, flexible cover sheet; and wherein there is further included:

a centrally located, initially flat paper spine located between the two sheets, of relatively stiff material with gaps between them forming hinges for the covers with respect to said channel spine and likewise being sandwiched between said interior cover sheet and said exterior cover sheet.

3. A method of binding a selected collection of sheet materials to a binding cover, comprising the steps of:

(a) providing a hard, book-like cover having a hard front cover and a hard back cover, integrally joined together at hinge lines by a centrally located, initially flat spine and in an intermediate step being formed into a "U" shaped channel having a base and an interior and a bottom at the base of the "U" shape, manufactured by (i) assembling an exterior, flexible cover sheet and an interior, flexible cover sheet on top of one another with two relatively stiff, spaced panels sandwiched between them within their side areas, turning over the ends of the exterior cover sheet over the peripheral edges of the interior side of the side covers with the interior cover sheet then put in place so that said side panels cannot be seen, producing a flat cover, and (ii) heating and applying centrally located, mechanical pressure means to the central part of the flat cover, forming the "U" shaped, channel spine extending completely across the flat cover and allowing the cover to cool;

(iii) thereafter applying a heat-flowable adhesive within the interior of the "U" shape over and along at least part of the channel spine's length, said heat-flowable adhesive substantially pooling when heated to flow up and around the edges of the sheet materials when located in said interior of said channel spine during the heating, binding step; with the end-user (b) placing one edge of the selected collection of sheet material into said spine interior in contact with said heat-flowable adhesive; and (c) using applied heat to melt said heat-flowable adhesive while said selected collection of sheet material is inserted into said interior of said channel spine, causing the adhesive to substantially pool and flow up and around the edges of the sheet materials and ultimately binding the sheet materials to said channel spine with the subsequent cooling and fixing of said adhesive.

4. The binding method of claim 3, wherein there is included in step (a)(i) the further step of:

inserting a paper spine between the two, exterior and interior cover sheets between the two panels with gaps between each of the panels, the gaps forming hinges for the binding cover, integrally attaching the front and back covers and the spine together in a flat array.

* * * * *